United States Patent [19]

Bonne

[11] Patent Number: 4,561,263

[45] Date of Patent: Dec. 31, 1985

[54] REFRIGERATION OR HEAT PUMP SYSTEM DEFROST

[75] Inventor: Ulrich Bonne, Hopkins, Minn.

[73] Assignee: Honeywell Inc., Minneapolis, Minn.

[21] Appl. No.: 660,663

[22] Filed: Oct. 15, 1984

Related U.S. Application Data

[63] Continuation-in-part of Ser. No. 479,419, Mar. 28, 1983, abandoned.

[51] Int. Cl.[4] ..... F25D 21/06

[52] U.S. Cl. ..... 62/176.2; 62/156

[58] Field of Search ..... 62/176.2, 151, 155, 62/156, 140, 234

[56] References Cited

U.S. PATENT DOCUMENTS

| | | | |
|---|---|---|---|
| 4,328,680 | 5/1982 | Stamp, Jr. et al. | 62/155 |
| 4,373,349 | 2/1983 | Mueller | 62/155 |
| 4,395,887 | 8/1983 | Sweetman | 62/155 |
| 4,417,452 | 11/1983 | Ruminsky | 62/156 |

FOREIGN PATENT DOCUMENTS

| | | | |
|---|---|---|---|
| 0020944 | 2/1981 | Japan | 62/155 |

OTHER PUBLICATIONS

U. Bonne, R. D. Jacobson, A. Patoni, D. A. Mueller and G. J. Rowley, "Electric Driven Heat Pump Systems: Simulations and Controls", 1979.

D. A. Mueller and U. Bonne, "New Heat Pump Control Functions via Microelectronics", Jun. 1980.

*Primary Examiner*—Harry Tanner

*Attorney, Agent, or Firm*—John P. Sumner

[57] ABSTRACT

Disclosed is a refrigeration or heat pump system comprising an evaporator coil and apparatus for initiating the defrost cycles of the evaporator coil at a frequency proportional to the difference between a water vapor pressure in air in the evaporator coil environment and a saturation water vapor pressure corresponding to the evaporator coil temperature.

6 Claims, 5 Drawing Figures

REFRIGERATION OR HEAT PUMP SYSTEM DEFROST

BACKGROUND OF THE INVENTION

This is a continuation-in-part of application Ser. No. 479,419, field Mar. 28, 1983 now abandoned.

The evaporator or outdoor heat exchanger coil of a heat pump operating in the heating mode, as well as evaporator coils in refrigerators and freezers, need periodic defrosting in order to maintain an acceptable level of heat transfer capability. In the prior art, the problem has been lack of a good determination of the point in time in which to initiate a defrost cycle. Both too frequent or too infrequent defrost cycles reduce overall system efficiency or coefficient of performance.

SUMMARY OF THE INVENTION

The present invention is a refrigeration or heat pump system comprising an evaporator coil and apparatus for initiating the defrost cycles of the evaporator coil at a frequency proportional to the difference between a water vapor pressure in air in the evaporator coil environment and a saturation water vapor pressure corresponding to the evaporator coil temperature.

DESCRIPTION OF THE PREFERRED EMBODIMENT

Figure 1:
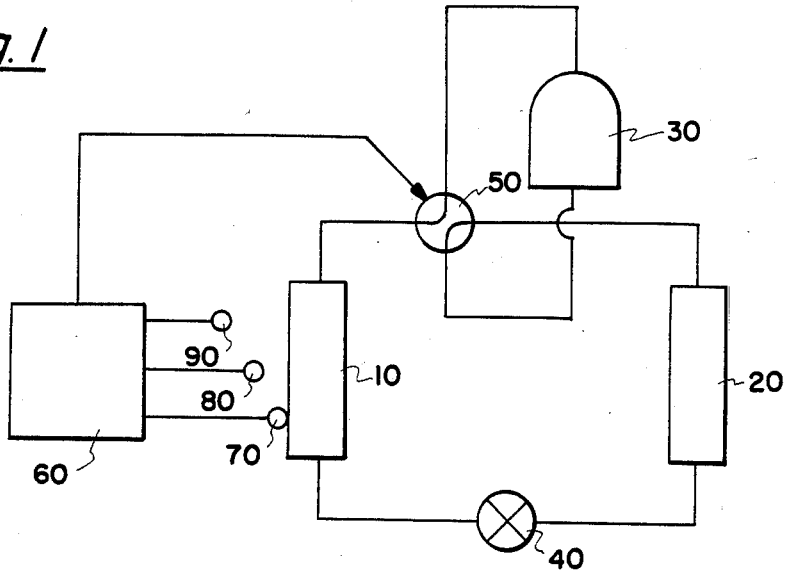
FIG. 1 illustrates a heat pump together with apparatus compatible with the present invention.

A heat pump is a reversible refrigeration system wherein the functions of the heat exchangers are interchangeable, permitting the heat pump to be a heater during the cold season and a cooler during the warm season. FIG. 1 illustrates a typical heat pump comprising first and second heat exchangers 10 and 20, a compressor 30, an expansion valve 40, and a four-way, two-position valve 50. Cold heat exchanger 10 (the one that absorbs the heat of vaporization from the air when the heat pump is operating in the heating mode) tends to frost over, particularly when it is drawing heat from cold and humid winter air. Since frost diminishes the effectiveness of heat exchanger 10, it is desirable to remove the frost. Typical systems that use the four-way, two position valve 50 accomplish this by reversing four-way value 50 so that condensor 10 becomes an evaporator and the frost (on what was formerly the evaporator) melts away. As previously indicated, too frequent or infrequent defrosts reduce the overall or system coefficient performance of the heat pump (or of the refrigerator or freezer).

Currently used defrost initiation methods include using a fixed timer based on either clock time or compressor run time, such as, for example, initiating defrost every 90 minutes when the compressor is running and the outdoor or coil environment temperature is below 9 degrees centigrade (48 degrees Fahrenheit). Alternate prior art methods involving initiating defrost after a predetermined pressure drop is reached across evaporator coil 10 or after evaporator coil 10 reaches a predetermined temperature below the outdoor or coil environment temperature.

None of the above prior art system, however, have involved the combined measurement of coil environment absolute humidity and coil temperature; however, this combination is a key factor in determining, in an optimum manner, when the evaporator coil should be defrosted.

Evaporator coil environment absolute humidity can be determined either by measuring absolute humidity directly (e.g., with a dew point meter) or by measuring the coil environment relative humidity and temperature and then determining the evaporator coil environment absolute humidity.

With these measurements, and in accordance with the present invention, the defrost cycle frequency of the evaporator coil is made proportional to the difference between a water vapor pressure in air in the evaporator coil environment and a saturation water vapor pressure corresponding to the evaporator coil temperature. Thus, as will be further discussed below, the present invention calls for measurement of either (1) evaporator coil environment temperature and relative humidity and evaporator coil temperature of (2) evaporator coil environment absolute humidity and evaporator coil temperature, transforming those measurements into the difference between the water vapor pressure in air in the evaporator coil environment and the saturation water vapor pressure corresponding to the evaporator coil temperature, and making the defrost cylce frequency of the evaporator coil proportional to that difference.

Figure 2:
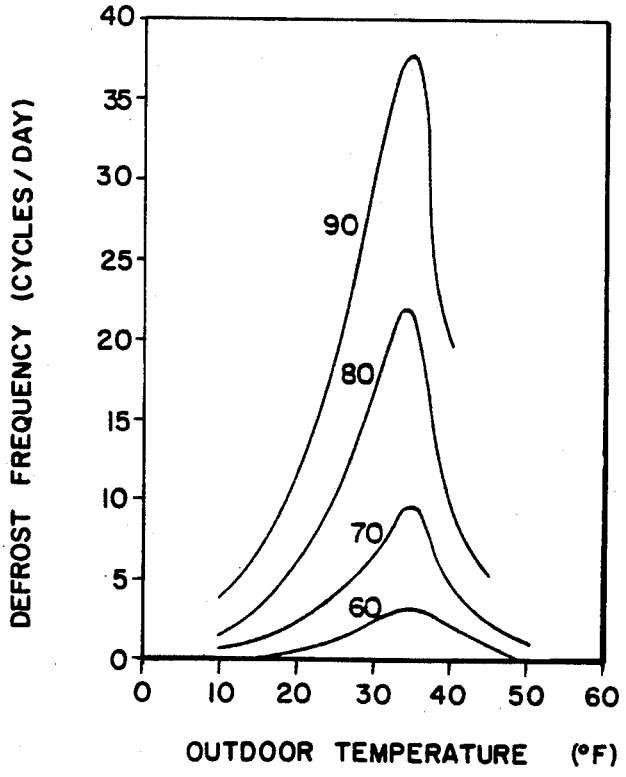
FIG. 2 illustrates examples of defrost frequency profiles corresponding to outdoor or coil environment temperature for a particular system.

FIG. 2 illustrates defrost frequency in cycles per day for the Honeywell W89 Heat Pump versus outdoor or coil environment temperature and relative humidities of 60, 70, 80 and 90 percent. The data of FIG. 2 were computed and confirmed experimentally for the Honeywell W89 Heat Pump Logic Control System using a validated computer program HFROST (see U. Bonne, R. D. Jacobson, A. Patani, D. A. Mueller and G. J. Rowley, "Electric Driven Heat Pump Systems: Simulations and Controls " (paper presented at the 4th Annual Heat Pump Technology Conference, 9–10 April 1979) and D. A. Mueller and U. Bonne, "New Heat Pump Control Functions via Microelectronics" (paper presented at the 1st EPRI/RWE Conference on Technology and Application of the Electric Heat Pump, Dusseldorf, West Germany, 18–20 June 1980, Proceedings, pg. 130); these papers are incorporated by reference in the present application as is fully set forth herein).

A relationship similar to that illustrated in FIG. 2 may be developed using the temperature of evaporator coil 10 rather then the outdoor or coil environment temperature. The level of particularity of the profiles may also be substantially increased, such as by providing more curves of constant relative humidity, or by providing a fine grid lookup table or by a mathematical algorithm relating the appropriate variables to defrost frequency.

However, such approaches are not independent of changes in the heat pump load size (or balance temperature) or of changes in the refrigerant charge or of changes in the relative heat pump coil load capacity. Heat pump load size influences the cycling rate at high outdoor temperatures and causes the drop in the right hand side of the curves of FIG. 2, thus determining the position of the maximum. Changes in the refrigerant charge and changes in the relative coil capacity influence the temperature difference between coil and air temperature, thus influencing the rate of frost build-up and the optimum defrost frequency that should be used.

It is therefore the purpose of the present invention to expand the validity of the above methods so that an improved defrost control is available which provides reliable and more energy efficient defrost operation and that is, in addition, independent of heat pump load (house size), coil capacity, and refrigerant charge.

This is accomplished by recognizing the physical driver for the formation of frost on the evaporator coil, i.e., that the frost build-up on the evaporator coil is proportional to the concentration gradient of water vapor between the air and the surface of the heat exchanger coil. The water vapor pressure in air in the evaporator coil environment is given by the absolute humidity (or dew point, calculatable from air temperature and relative humidity), and the saturation water vapor pressure corresponding to the evaporator coil temperature can be determined by measuring the coil temperature.

One convenient formula used to compute the saturation water vapor pressure, $PH_2O$, as a function of temperatuer, T is $$pH_2O = p_o \exp((10322(3650-T)/(T+3054))/2(1/373.15-1/T))$$

where $pH_2O$ is given in atmospheres, T is given in °K, and $p_o$ is one atmosphere.

Figure 3:
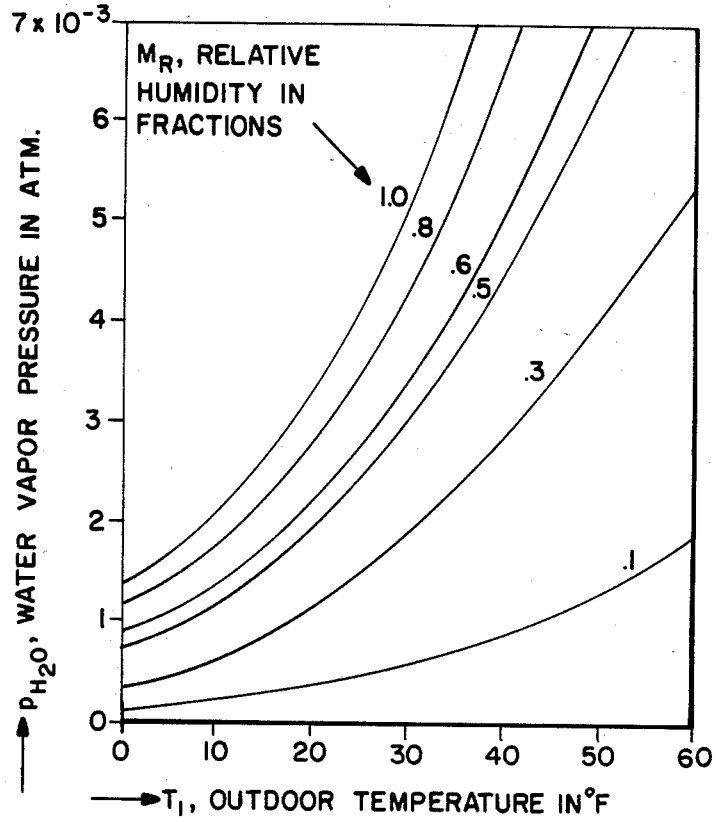
FIG. 3 illustrates the saturation (or maximum or total) water vapor pressure that is potentially capable of causing frost build-up versus outdoor or coil environment temperature. This vapor pressure would therefore be proportional to the defrost frequency that a system would use that only measures air humidity and air temperature, as proposed by Sweetman in U.S. Pat. 4,395,887.

FIG. 3 shows this relationship in graphical form, after converting °K into °F. One can see that the increase in relative humidity and outdoor or coil environment temperature cause an increase in the water vapor pressure $pH_2O$. However, defrosting according to a frequency that is proportional to $pH_2O$ leads to too frequent defrost for two reasons: (1) curves of constant relative humidity are too closely spaced compared to FIG. 2, which was determined mathematically and verified experimentally to correspond to the most energy efficient defrost frequency as explained in the above references by Bonne, et.al, and (2) there are relative humidities at which no defrosting is needed, for example, for all relative humidities smaller than 60 percent when the outdoor temperature is below approximately 50 degrees Fahrenheit for the system depicted in FIG. 4 and for all relative humidities smaller than 50 percent when the outdoor temperature is below approximately 35 degrees Fahrenheit for the system depicted in FIG. 4a.

The key question then becomes: what is the best function to use as the basis for defrost frequency?

The present invention provides an answer to this question. Accordingly, as depicted in FIGS. 4 and 4a and described above, the present invention makes defrost cycle frequency proportional to the difference between a water vapor pressure in air in the evaporator coil environment and a saturation water vapor pressure corresponding to the evaporator coil temperature.

Figure 4:
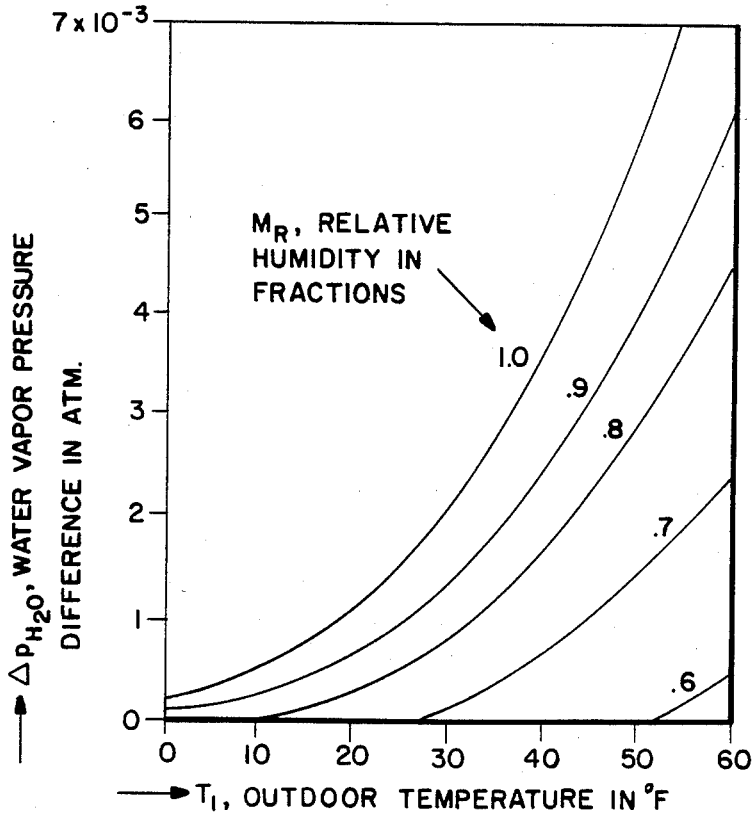
FIGS. 4 and 4*a* illustrate for two different heat pumps the available water vapor pressure that is actually involved in causing the frost build-up versus outdoor or coil environment temperature. This vapor pressure is much smaller than in FIG. 3 and is proportional to the more accurate defrost frequency proposed by the present invention. A defrost control built on this basis can therefore save defrost cycles and energy compaired to one based on FIG. 3.
Figure 4A:
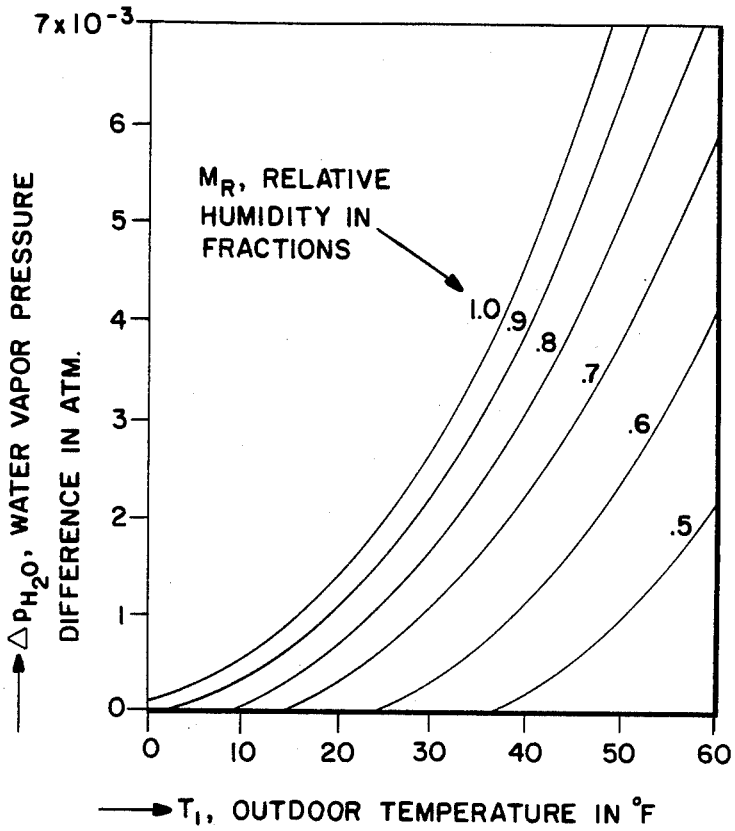

FIGS. 4 and 4a illustrate graphically that the spread between the curves of constant relative humidity are close to the spread of those of FIG. 2. Further, it can be seen from these Figures that the shape of the curves are similar to the left side of the maxima of the curves in FIG. 2. The right side of the curves of FIG. 2 are also represented properly by those of FIGS. 4 and 4a if one remembers that the cycling operation causes the defrost frequency to drop automatically as outdoor or coil environment temperature increases and to go to zero altogether after reaching a predetermined value above the ice point as taught, for example, by Ruminsky and Serber in U.S. Pat. 4,417,452.

FIGS. 4 and 4a show two relationships between the outdoor air or coil environment temperature, $T_1$, relative humidity, $M_R$, and the difference in the partial pressure of water vapor in air and on the coil, (delta) $pH_2O$, corresponding to two different heat pumps. The graphs of FIGS. 4 and 4a are different because the proportionality constant for different heat pumps is determined empirically and is influenced by evaporator coil geometry such as fin spacing and depth.

The graph of FIG. 4 was drawn for one type of heat pump for which the evaporator coil temperature, $T_3$, was found experimentally to be related to the outdoor or coil environment temperature, $T_1$, by the relationship $T_3 = .8T_1 - 3$, in °F. A similar relationship, $T_3 = .6T_1 - 2.2$, in °F, illustrated in FIG. 4a, was determined for another heat pump. These relationships were obtained by measuring $T_3$ for various $T_1$ values.

FIGS. 4 and 4a thus show how prior art defrost initation methods ( dependent on $T_1$) required a different algorithm or graph for each heat pump, while all are derived from the same, basic, $T_1$-independent relationship as follows:

$$(\text{delta})\ pH_2O = p_{air} - p_{coil}$$

where $p_{air}$ is the water vapor pressure in air and $p_{coil}$ is the saturation water vapor pressure corresponding to the coil temperature; i.e., where $P_{air} = M_R p\ (T_1)$ and $P_{coil} = P(T_3)$.

Accordingly, the performance of defrost controls based on prior art such as Sweetman and Ruminsky et.al. was dependent upon the individual heat pump operating characteristics, while that of controls based on the present invention is much less dependent on them. In fact, FIG. 3 shows that the defrost frequency of prior art controls would still be positive when it in fact should be zero since no condensation and frost formation can occur if $M_R p\ (T_1)$ is less than $p(T_3)$, i.e., if the water vapor pressure in air in the coil environment is smaller than the saturation water vapor pressure corresponding to the evaporator coil temperature.

FIG. 1 illustrates apparatus compatible with the present invention. A controller 60 comprising a standard digital computer is coupled to a temperature sensor 70 for monitoring the temperature of evaporator coil 10 and a sensor 90 for measuring the outdoor or coil environment humidity. If sensor 90 is an absolute humidity sensor (e.g., a dew point sensor), no sensor is required for measuring the outdoor or coil environment temperature. However, if sensor 90 measures outdoor or coil environment relative humidity (e.g., by a polyimide or ceramic sensor), a sensor 80 will also be required for monitoring the outdoor or coil environment temperature so that the outdoor or coil environment absoute humidity can be determined.

Controller 60 is programmed to initiate a defrost cycle whenever the compressor operating time has reached a value that equals or exceeds one computed by controller 60 on the basis of the above (delta) $pH_2O$. This time is computed to progress at a rate that is proportional to (delta) $pH_2O$ such that defrost cycle frequency is proportional to the average (delta) $pH_2O$ between defrost cycles.

The present invention is to be limited only in accordance with the scope of the appended claims, since persons skilled in the art may devise other embodiments still within the limits of the claims.

The embodiments of the invention in which an exlusive property or right is claimed are defined as follows:

1. Apparatus of initiating the defrost cycles of an evaporator coil in a refrigeration or heat pump system comprising:

an evaporator coil; and means for initiating the defrost cycles of the evaporator coils at a frequency proportional to the different between a water vapor pressure in air in the evaporator coil environment and a saturation water vapor pressure corresponding to the evaporator coil temperature.

2. The apparatus of claim 1 wherein the means for initiating comprises:

means for monitoring the evaporator coil temperature; and means for monitoring an absolute humidity in the evaporator coil environment.

3. The apparatus of claim 1 wherein the means for initiating comprises:

means for monitoring the evaporator coil temperature;

means for monitoring the relative humidity in the evaporator coil environment; and means for monitoring air temperature in the evaporator coil environment.

4. Apparatus for initiating the defrost cycles of an evaporator coil in a refrigeration or heat pump system, comprising:

means for monitoring the evaporator coil temperature;

means for monitoring an absolute humidity in the evaporator coil environment; and means for initiating the defrost cycles of the evaporator coil at a frequency proportional to the difference between a water vapor pressure in air in the evaporator coil environment and a saturation water vapor pressure corresponding to the evaporator coil temperature.

5. The apparatus of claim 1 wherein the means for monitoring the absolute humidity in the evaporator coil environment comprises means for monitoring a relative humidity in the evaporator coil environment and means for monitoring an air temperature in the evaporator coil environment.

6. Apparatus for initiating the defrost cycles of an evaporator coil in a refrigeration or heat pump system, comprising:

means for monitoring the evaporator coil temperature;

means for monitoring a relative humidity in the evaporator coil environment;

means for monitoring an air temperature in the evaporator coil environment; and means for initiating the defrost cycles of the evaporator coil at a frequency proportional to the difference between a water vapor pressure in air in the evaporator coil environment and a saturation water vapor pressure corresponding to the evaporator coil temperature.

* * * * *